United States Patent [19]

Morel et al.

[11] 4,169,034

[45] Sep. 25, 1979

[54] MEANS OF COMPENSATING THE MAGNETIC FIELD INDUCED BY THE ADJACENT LINE IN SERIES OF HIGH INTENSITY ELECTROLYSIS CELLS

[75] Inventors: Paul Morel, Le Vesinet; Jean-Pierre Dugois, Saint-Jean-de-Maurienne, both of France

[73] Assignee: Aluminium Pechiney, Lyons, France

[21] Appl. No.: 925,849

[22] Filed: Jul. 18, 1978

[30] Foreign Application Priority Data

May 11, 1978 [FR] France ..... 78 14676

[51] Int. Cl.[2] ..... C25C 3/16

[52] U.S. Cl. ..... 204/243 M; 204/244

[58] Field of Search ..... 204/243 M, 243 R, 244–247, 204/67

[56] References Cited

U.S. PATENT DOCUMENTS 3,616,317 10/1971 McLellan et al. ..... 204/243 M 3,756,938 9/1973 Nebell ..... 204/243 M 3,775,280 11/1973 Nikiforov et al. ..... 204/243 M

*Primary Examiner*—John H. Mack

*Assistant Examiner*—D. R. Valentine

*Attorney, Agent, or Firm*—Dennison, Dennison, Meserole & Pollack

[57] ABSTRACT

A means of compensating the magnetic field induced by the adjacent line in series of high intensity electrolysis cells placed in a transverse direction. A compensating conductor traversed by a direct current which induces an antagonistic field neutralizing the parasitic field of the adjacent line is arranged along each line on the internal side and/or on the external side. Excellent compensation is achieved by regulating the intensity in each conductor and the distance between the conductor and the line.

Application may be to series of igneous, very high intensity electrolysis cells for the production of aluminum.

4 Claims, 5 Drawing Figures

MEANS OF COMPENSATING THE MAGNETIC FIELD INDUCED BY THE ADJACENT LINE IN SERIES OF HIGH INTENSITY ELECTROLYSIS CELLS

BACKGROUND OF THE INVENTION

The present invention relates to a means of compensating the magnetic field induced by the adjacent line in series of high intensity igneous electrolysis cells arranged transversely to the axis of the series. It applies particularly to series of igneous electrolysis cells for the production of aluminum by electrolysis of alumina dissolved in molten cryolite.

Industrial production of aluminum is often carried out by igneous electrolysis, in cells electrically connected in series, of a solution of alumina in cryolite brought to a temperature of the order of 950° to 1000° C. by the Joule effect of the current passing through the cell.

Each cell comprises a rectangular cathode forming a crucible, the bottom of which is formed by blocks of carbon fixed on rods of steel known as cathode rods which serve to evacuate the current from the cathode toward the anodes of the following cell. The anode system, also made of carbon, is fixed beneath an anode bus bar super-structure and is connected to the cathode rods of the preceding cell.

The electrolysis bath, that is to say the solution of alumina in cryolite, is located between the anode system and the cathode. The aluminum produced is deposited on the cathode. A layer of liquid aluminum about 20 cm thick is permanently kept at the bottom of the cathode crucible to provide a thermal fly-wheel effect.

Since the crucible is rectangular, the anode rods supporting the anodes are generally parallel to its large edges while the cathode rods are parallel to its small edges known as cell heads.

The cells are arranged in lines in a longitudinal direction or in a transverse direction depending upon whether their large side or their small side is parallel to the axis of the line. The cells are electrically connected in series, the ends of the series being connected to the positive and negative outputs of an electrical rectification and regulation sub-station. Each series of cells comprises a certain number of lines branched in series, the number of lines preferably being even so as to avoid needless lengths of conductors.

The electric current which travels through the various conductors such as electrolyte, liquid metal, anodes, cathodes and connecting conductors, creates large magnetic fields. These fields induce in the electrolysis bath and in the molten metal contained in the crucible so-called Laplace forces which are harmful to the proper functioning of the cell owing to the movements which they create. The layout of the cell and of its connecting conductors is designed so that the magnetic fields created by the different parts of the cell and the connecting conductors compensate each other. A cell having the vertical plane parallel to the line of cells and passing through the center of the crucible as its plane of symmetry is thus obtained. However, the cells are also subjected to interfering magnetic fields emanating from the adjacent line or lines. The term "adjacent line" means the line nearest the line under consideration and the term "field of the adjacent line" means the resultant of the fields of all the lines apart from the line under consideration.

In the following, the normal conventions will be adopted:

- upstream and downstreams by reference to the direction of the electric current in the series,
- Bx, By and Bz, the components of the magnetic field along the axes Ox, Oy an Oz in a direct right-angled trihedron, whose center O is the center of the cathode plane of the cell, Ox is the longitudinal axis in the direction of the cell, Oy is the transversal axis and Oz is the vertical axis directed upwards,
- internal side of a cell, that which is situated toward the adjacent line and external side, that opposing the adjacent line.

Methods of compensating the magnetic field induced by the adjacent line have already been described in the past: Note U.S. Pat. No. 3,063,919, assigned to Pechiney, describes a demagnetizing loop device for attenuating the field of the adjacent line by making the return current come back for each line either beneath the line of cells or in the centre of the row of two lines of cells. Although this method is effective, it lengthens the conductors considerably.

U.S. Pat. No. 3,616,317 applies solely to series in which the cells are arranged in a lengthwise direction. It describes a device involving the positioning on the external surface of series arranged in two parallel lines, of a compensating conductor traversed by a direct current travelling in the opposite direction to that of the electrolysis current in the adjoining series and of equal strength at about 25% of the electrolysis current.

U.S. Pat. Nos. 4,072,597, and 4,090,930, assigned to Aluminum Pechiney, also describe methods of compensating the magnetic field of the adjacent line, but they operate cell by cell and not on the entire line and do not therefore arise from the same inventive idea.

However, the majority of these different prior art methods are unsuitable for compensating the magnetic field induced by the adjacent line or lines in the most recent installations where the intensity can reach and even exceed 200,000 amperes.

It would therefore be necessary to increase substantially the distance between lines in order to maintain an acceptable value at the field of the adjacent line. An unacceptable increase in certain expenses such as for ground, substructure amd length of the connecting conductors between lines of cells would thus result and diminish the profit on the investment allowed by the use of cells of high amperage.

The present invention relates precisely to a means of compensating the magnetic field of the adjacent line in series of very high intensity electrolysis cells arranged in a transverse direction.

It is essentially characterized by the installation, without modification of existing cells, of at least one auxiliary conductor, parallel to the Ox axis and situated in the plane of the bath/metal interface as near as possible to the pot that is to say to the external metal envelope of the cell. A direct current of an intensity selected so as to provide the desired compensation is passed into this auxiliary conductor in a suitable direction.

IN THE DRAWINGS

Figure 1:
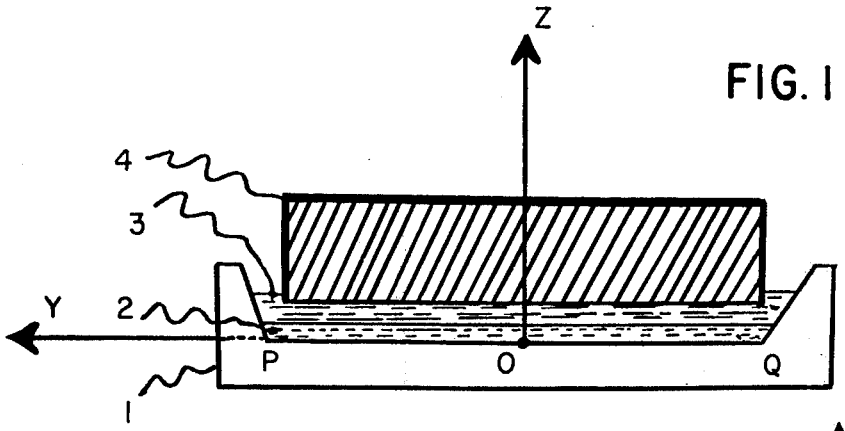
FIG. 1 shows diagrammatically a cross-section passing through the point 0 defined above of an electrolysis cell arranged transversely to the axis of the series, the Ox axis therefore being perpendicular to the plane of the figure.

In FIG. 1, the box is designated by 1, the sheet of liquid aluminum by 2, the electrolyte by 3 and the anode system by 4.

The magnetic field created by a line of cells on a cell of another line is vertical. If M (as in FIG. 2) is any point on a cell, the field created at M by the adjacent line is of constant sign and decreases in a manner which is very slightly hyperbolic when the point M shifts from the small edge situated nearest the adjacent line to the small edge furthest from the adjacent line. This field is represented by the curve F in FIGS. 3, 4 and 5 and corresponds to an adjacent line situated on the edge of the positive y.

Figure 2:
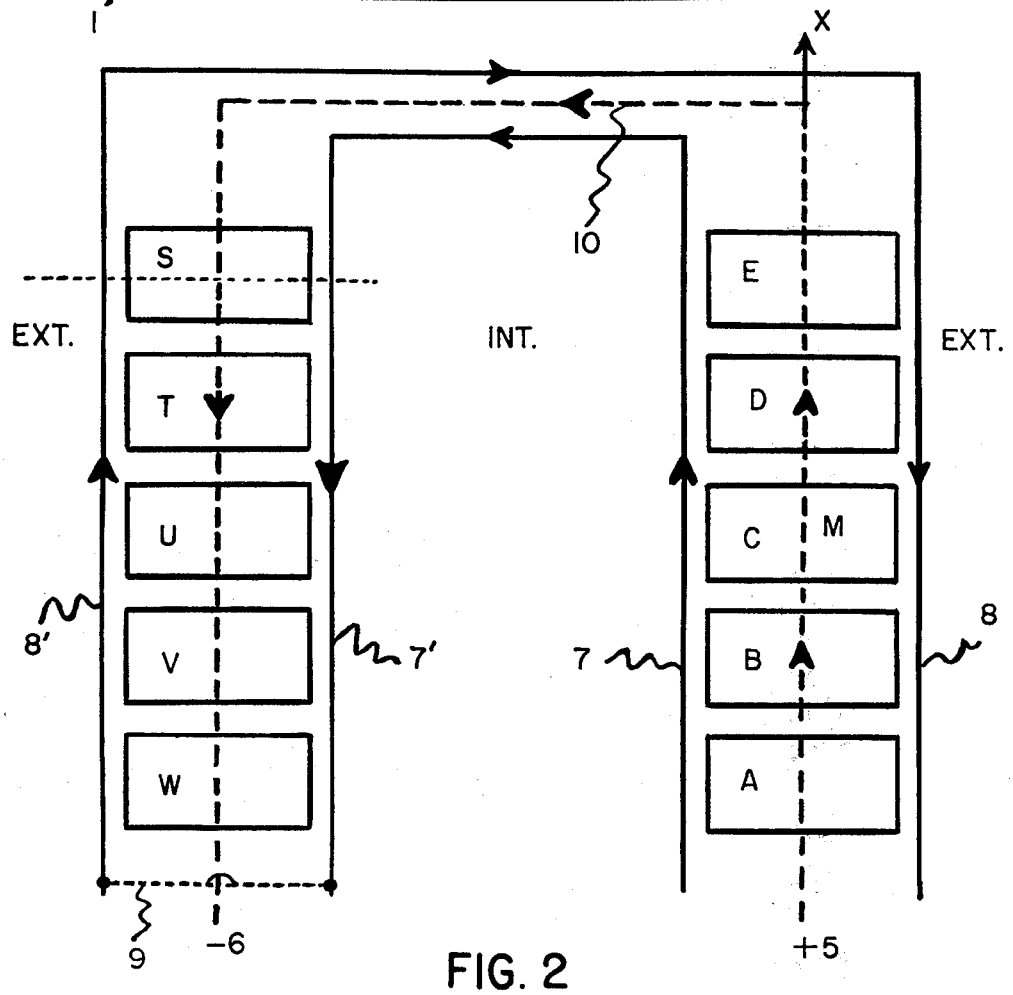
FIG. 2 shows diagrammatically a top view of a series of electrolysis cells separated into two parallel lines. In order to simplify the drawing, only five cells have been shown per line (A, B, C, D, E and S, T, U, V, W) but, in industrial practice, each line frequently comprises about 100 cells in series.

FIG. 2 shows part of a series of electrolysis cells arranged in two parallel lines. The positive pole of the source of direct electrolysis current is connected on the side known as the "head" at 5 and the negative pole on the side known as the "tail" at 6.

The head of the series 5 is connected to the positive pole of the generator of direct electrolysis current and the tail 6 is connected to the negative pole of the same generator. The auxiliary conductors intended to compensate the field of the adjacent line are at 7, 7′ on the internal side of the series and at 8, 8′ on the external side of the series. They may be joined by means of the connector 9. The dotted line 10 represents the passage of the electrolysis current. The compensating conductor 7, 7′ has been arranged along the internal side of the cells and the compensating conductor 8, 8′ along the external side of the cells. Both compensating conductors can be supplied with direct current, either separately or by positioning in series by means of the conductor 9 shown in a broken line from an auxiliary rectifier supplying an intensity which can attain 30,000 amperes, at a relatively low voltage corresponding to the only drop in voltage in the conductors which can be, for example of the order of 10 millivolts per meter. The total power dissipated in these compensating conductors is therefore very low in relation to the electrolysis energy.

Figure 3:
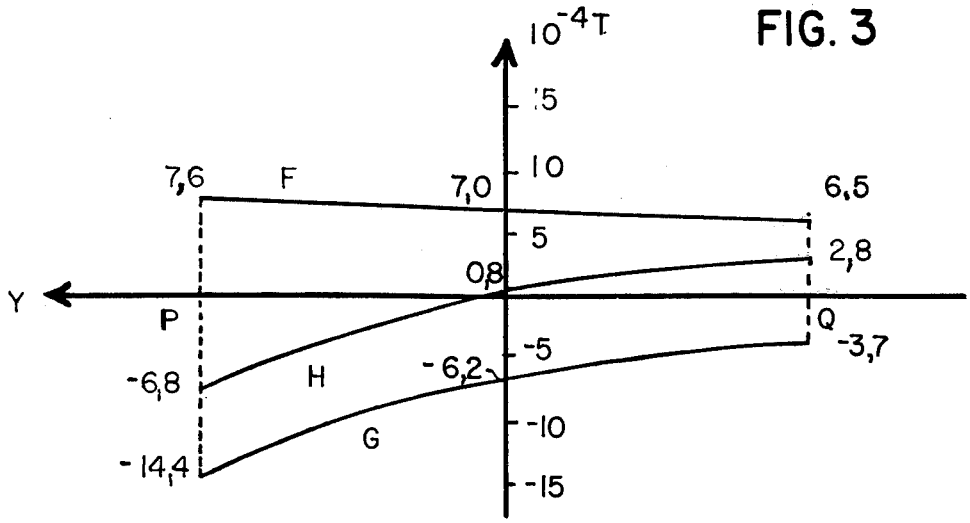
FIGS. 3, 4 and 5 show the graphs of compensation of the field of the adjacent line according to three variations of the method according to the invention.

In FIG. 3, the graph of the magnetic fields has been plotted for the case where the internal compensating conductor 7, 7′ is the only one supplied, at an intensity of 30 KA, the current circulating in the opposite direction to that of the electrolysis current in the adjacent line, therefore in the same direction as that in the adjoining line.

This compensating conductor 7 therefore creates on each adjoining cell (A, B, C, D, E . . . .) a vertical field having a direction which is constant and opposite to that of the field created by the adjacent line (S, T, U, V, W . . .) having an intensity which decreases in an almost hyperbolic manner since $B=2i/d$ (B being the magnetic field at $10^{-4}$ Tesla,* i being the intensity in kiloamperes and d being the distance in meters), travelling from the internal side to the external side. In fact, this compensating field is due both to the adjoining compensating conductor 7 and to the equivalent compensating conductor 7′ placed on the adjacent line. This is represented by the curve G in FIG. 3.

*A unit of magnetic induction equal to one weber per square meter.

The curve in FIG. 3 is the algebraic sum of F+G and represents the resulting field.

Figure 4:
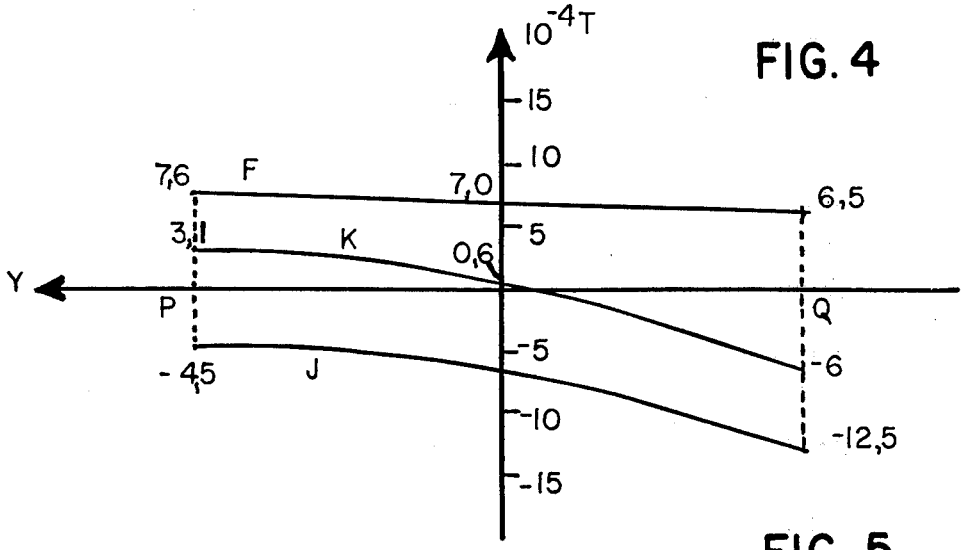

In FIG. 4, the graph of the magnetic field has been plotted for the case where the external compensating conductor 8, 8′ is the only one supplied, at an intensity of 22 KA, the current circulating in the opposite direction to that of the electrolysis current in the adjoining line, therefore in the same direction as in the adjacent line.

This conductor creates on each adjoining cell (A, B, C, D, E) a vertical field having a direction which is constant and is opposite to that of the field created by the adjacent line and having an intensity which decreases in an almost hyperbolic manner (since $b-2/d$) travelling from the external side toward the internal side of the cell. In fact, this compensating field is due both to the adjoining compensating conductor 8 of the cell and, on the other hand, to the equivalent compensating conductor 8′ installed on the adjacent line. This field is represented by the curve J in FIG. 4.

The curve K in FIG. 4 is the algebraic sum of F+J and represents the resulting field.

Figure 5:
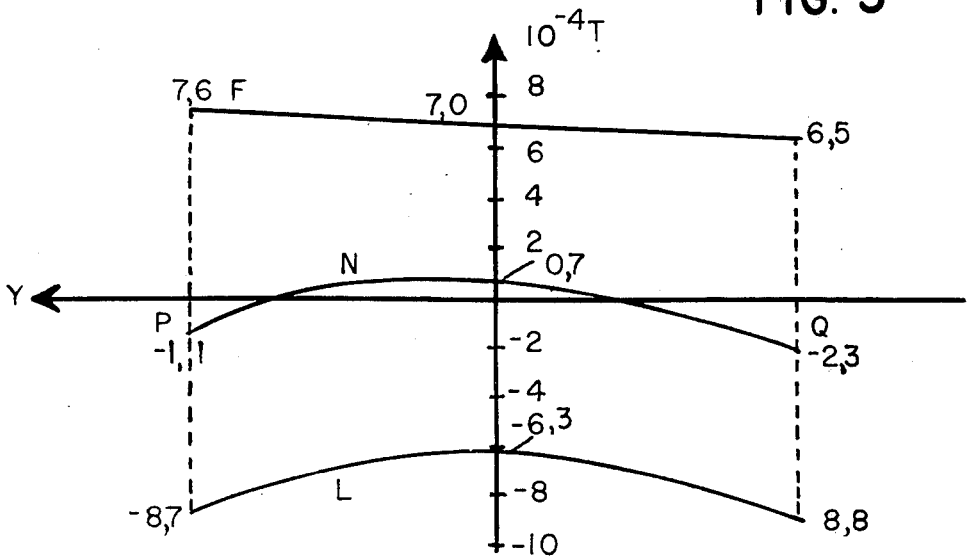

In FIG. 5, the graph of the magnetic fields has been plotted for the case where the two compensating conductors 7, 7′ and 8, 8′ are supplied and placed in series by the junction 9, the direction of the current being the same in each of them as in the two preceding cases and the intensity being fixed at 13 KA.

These conductors create on the cell a vertical field having a direction which is constant and is opposed to that created by the adjacent line, and having an intensity which is slightly lower in the center of the cell (on the Ox axis) than on its edges.

In fact, this field is due to the two compensating conductors adjoining the cell 7, 8 and to the compensating conductors situated along the adjacent line 7′, 8′.

The compensating field is represented by the curve L in FIG. 5 and the resulting field, the algebraic sum of F+L is represented by the curve N. In order to make the figure clearer, a larger scale has been adopted for the ordinate axis than for FIGS. 3 and 4.

The intensity at which the compensating conductors will be supplied must be determined in view of optimum compensation. In practice, compensation is achieved with a current whose intensity does not exceed 20% of the intensity of the electrolysis current. Since the compensating conductors can be assimilated to infinite conductors, the field which they create on the cell at a point M is practically independent of the abscissa of M.

If $B_F(M)$ represents the field created by the adjacent line at M, and $B_C(M)$ represents the field created by the compensating conductors at M, the total field $B_T(M)$ will be equal to $B_F(M)=B_C(M)$.

The value i of the intensity of the compensating conductors will be selected so that the average value of $B_t$ on the large axis of the cell will be zero, based on the equation $B=2i/d$.

The resulting field is represented by the curves H, K, N in FIGS. 3, 4 and 5 respectively.

Three ways of carrying out the method forming the subject of the invention are thus available, depending whether one or the other or both compensating conductors are supplied with current.

With the mode of carrying out the invention according to FIG. 3, which we will call "variation No. 1", the average value of the field $B_T$ has the opposite sign to $B_F$ on the internal side and the same sign as $B_F$ on the internal side.

With the mode of operation according to FIG. 4, which we will call "variation No. 2", $B_T$ has the same sign as $B_F$ on the internal side and the opposite sign on the external side.

With the mode of operation according to FIG. 5, which we will call "variation No. 3", the field $B_T$ is very weak all over.

Now let us consider a cell in the absence of adjacent lines: the conductors which supply the cell as well as the cell itself are symmetrical about the plane xoz. As a result, the vertical component of the field of the cell without adjacent line is antisymmetrical about y, that is to say that if y is changed into −y, Bz changes into −Bz. Taking into consideration the cell cut along its transversal axis, the average value of Bz on one side of the cell (for example on the side of the negative y) is equal to and has the opposite sign to the average value of Bz on the other side.

A well-known criterion for the proper functioning of the cell is that the average value of Bz be as low as possible. The choice between one of the three variations for carrying out the method according to the invention is thus made in the following manner:

The average value of the vertical field of the cell in the series is measured for the internal half and for the external half of the cell, that is to say $\overline{Bi}$ (cell plus adjacent line) and $\overline{Be}$ (cell plus adjacent line). Calculations show that these would be the average values in the absence of adjacent line: that is to say $\overline{B'i}$ (without adjacent line) and $\overline{B'e}$ (without adjacent line).

A check is made to ensure that the ratio of these two values $\overline{B'i}/\overline{B'e}$ hardly differs from −1.

Of the three variations, the one is therefore selected for which the average value of the vertical field of the cell with the adjacent line and the compensating conductors is as low as possible in absolute value in each of the half-cells, internal and external.

That is to say that if $\overline{B'i}$ (without adjacent line) has the same sign as the field created by the adjacent line, the first variation will be adopted (FIG. 3).

If $\overline{B'i}$ (without adjacent line) has the opposite sign to that of the field created by the adjacent line, the second variation will be adopted (FIG. 4).

If $\overline{B'i}$ (without adjacent line) is very low, for example below one-tenth of the field created by the adjacent line, the third variation will be adopted.

EXAMPLE

A series of electrolysis cells functioning at 175 KA and arranged in two parallel lines with their axes 50 m apart are considered. The anode system is 8.4 meters long. The compensating conductors are placed 8 m from the center of the cell, internal side and/or external side.

The following table shows the values of the total vertical magnetic field ($B_T$) according to each of the variations adopted.

| Field in $10^{-4}$ Tesla | Variation No. 1 | Variation No. 2 | Variation No. 3 |
|---|---|---|---|
| Average value: internal side | | | |
| $B_F$ | 7.3 | 7.3 | 7.3 |
| $B_C$ | −9.3 | −5.3 | −7.0 |
| $B_T = B_F + B_C$ | −2.0 | 2.0 | 0.3 |
| Average value: external side | | | |
| $B_F$ | 6.7 | 6.7 | 6.7 |
| $B_C$ | −4.7 | −8.7 | −7.0 |
| $B_T = B_F + B_C$ | 2.0 | 2.0 | 0.3 |
| Intensity in the compensating conductor or conductors | 30 KA | 22 KA | 13 KA |

Experience shows that the effect of magnetization (that is to say the screen effect produced by the ferromagnetic masses formed by the box, the super-structure, the cathode rods and possibly the building), on the field created by the adjacent line on the one hand and on the field created by the compensating conductors on the other hand is such that the value of the intensity corresponds to the cancellation of the integral of the real field:

$$\int_P^Q B_T = 0$$

hardly differs from that given by calculation ignoring the effect of magnetization.

We claim:

1. A means for compensating the magnetic field which is induced in a linearly arranged series of electrolysis cells each containing a metal pot by an adjacent generally parallel line of cells, said cells being oriented transverse to the axis of the series, said pot containing a layer of liquid aluminum on the bottom thereof comprising first and second compensating electrical conductors situated substantially at the same level as the layer of liquid aluminum and spaced laterally from at least one side of each series of cells, a source of direct current connected to said conductor, said first conductor being spaced inwardly from the inner sides of said cells, and said second conductor being spaced outwardly from the outer side of said cells, thereby defining an internal and external conductor for each cell series.

2. Means for compensating the magnetic field as defined in claim 1 wherein the direct current in the internal conductor flows in the same direction as the electrolysis current of the adjoining cell line and in the direction opposite to the electrolysis current in the adjacent line, and the direct current in the external conductor flows in the opposite direction as the electrolysis current of the adjoining cell line and in the same direction as the electrolysis current in the adjacent line.

3. Means for compensating the magnetic field as defined in claim 1, wherein the internal and external conductors are connected in series, and are supplied by a direct current circulating in the internal conductor in the same direction as the electrolysis current of the adjoining line and, in the external conductor, in the opposite direction to the electrolysis current of the adjoining line.

4. Means for compensating the magnetic field as defined in claim 1, wherein the intensity of the current circulating in the compensating conductor is selected based on the equation, $B=2i/d$ where B = magnetic field at $10^{-4}$ Tesla, i = intensity of current in killoamperes, and d = distance in meters, so that the average of the total magnetic field, $B_T$ is 0 on the larger axis of the cell.

* * * * *